US008936499B2

(12) United States Patent
Gouvernet

(10) Patent No.: US 8,936,499 B2
(45) Date of Patent: Jan. 20, 2015

(54) FLIPPER EQUIPPED WITH AN ASYMMETRICAL FLEXING WING SECTION

(75) Inventor: Guillaume Gouvernet, Saint Cyprien Village (FR)

(73) Assignee: Decathlon, Villeneuve d'Ascq (FR)

( * ) Notice: Subject to any disclaimer, the term of this patent is extended or adjusted under 35 U.S.C. 154(b) by 400 days.

(21) Appl. No.: 12/948,260

(22) Filed: Nov. 17, 2010

(65) Prior Publication Data

US 2011/0117801 A1 May 19, 2011

(30) Foreign Application Priority Data

Nov. 18, 2009 (FR) ..... 09 58130

(51) Int. Cl.
*A63B 31/11* (2006.01)

(52) U.S. Cl.
CPC ..... *A63B 31/11* (2013.01)
USPC ..... 441/64

(58) Field of Classification Search
CPC ..... A63B 31/08; A63B 31/10; A63B 31/11; A63B 2031/08; A63B 2031/10; A63B 2031/11; A63B 2031/112; A63B 2031/115; A63B 2031/117
USPC ..... 441/61–64
See application file for complete search history.

(56) References Cited

U.S. PATENT DOCUMENTS

| | | | | |
|---|---|---|---|---|
| 4,007,506 | A | 2/1977 | Rasmussen | |
| 5,324,219 | A * | 6/1994 | Beltrani et al. | 441/64 |
| 6,126,503 | A * | 10/2000 | Viale et al. | 441/64 |
| 6,159,064 | A * | 12/2000 | Takeuchi et al. | 441/64 |
| 6,290,561 | B1 * | 9/2001 | Garofalo et al. | 441/64 |
| 6,394,863 | B1 * | 5/2002 | Chen | 441/64 |
| 7,815,477 | B2 * | 10/2010 | Garofalo | 441/64 |

FOREIGN PATENT DOCUMENTS

| | | | | |
|---|---|---|---|---|
| DE | 43 38 610 | A1 | 5/1995 | |
| FR | 1 361 410 | A | 5/1964 | |
| FR | 2 455 905 | A1 | 12/1980 | |
| FR | 2611509 | A1 * | 9/1988 | A63B 31/11 |

* cited by examiner

*Primary Examiner* — Ajay Vasudeva
(74) *Attorney, Agent, or Firm* — Kenyon & Kenyon LLP

(57) ABSTRACT

A flipper including a bootee extended to the front by a flexible wing section, at least one flexible element placed in the direction of the length under the flexible wing section and a securing portion arranged between the proximal part of the flexible element and the proximal part of the flexible wing section.

15 Claims, 2 Drawing Sheets

FLIPPER EQUIPPED WITH AN ASYMMETRICAL FLEXING WING SECTION

FIELD OF THE INVENTION

The invention relates to a swimming flipper which can also be used as a muscle-training tool in water.

BACKGROUND OF THE INVENTION

Currently known flippers comprise especially a bootee and a wing section. The bootee can be closed or open at the rear, the foot in this case being held in said open bootee by means of a strap supported on the heel. The wing section extends to the front of the bootee to which it is secured.

During swimming, that is, during an upward movement and a downward movement of the flipper corresponding to flapping of the feet, the wing section flexes respectively downwards and upwards. During the descent phase, the knee extends and the hip flexes, while inversely during the ascent phase the knee flexes and the hip extends; the swimmer has more power during the descent phase than the ascent phase. A major drawback to currently known flippers is not exploiting this variation in power during flapping of feet, given that the wing section flexes identically in one direction or in the other during flapping of the feet, that is, the wing section flexes symmetrically.

Document FR 1 361 410 is known which discloses a flipper whereof the aim is to be able to vary the flexibility of the wing section. To achieve this, longitudinal conduits are arranged on the underside of the wing section, which allow introduction of stiffening rods. Such a design ably replaces rods by other more or less flexible rods, helping to vary the flexibility of the wing section. This design however ensures symmetrical flexing of the wing section during flapping of the feet during swimming.

Document DE 4 338 610 is also known which discloses a flipper comprising a bootee, a wing section and two flexible elements fixed to the bootee and extending to the front of the flipper, respectively above and below the wing section. As a function of the flexibility of each of the two flexible elements this produces asymmetrical flexing of the wing section during descent and ascent movement of the flipper during swimming.

SUMMARY OF THE INVENTION

The aim of the flipper forming the subject matter of the present invention is to eliminate this disadvantage present in current flippers. Another aim of the flipper forming the subject matter of the present invention is to make the muscle groups of the swimmer work differently, thus using the flipper as a specific muscle-training tool. These aims are also attained with the flipper according to document DE 4 338 610. The aim of the present invention however is to simplify the design of such a flipper.

For this purpose, the invention relates to a flipper comprising a bootee which can be open or closed at the rear, such as already seen on current flippers, said bootee being extended to the front by a flexible wing section, that is, this wing section is fixed to the front of the bootee, the fixing of the wing section to the bootee able to be done by any known means, such as for example by moulding of the flexible wing section to the front of the bootee.

According to the invention, the flipper comprises at least one flexible element comprising at least two branches extending in the direction of the length under the flexible wing section and a base, a securing portion being arranged between the base of this flexible element, and the proximal part of the flexible wing section, that is the one located near the front end of the bootee.

It is understood that according to the invention only the proximal part of the flexible element placed under the flexible wing section is fixed with the proximal part of said flexible wing section, whereas the complementary part of this flexible element, extending under the wing section in the direction of its length, remains free vis-à-vis said flexible wing section. So, the flexible element acts as a stiffener, being in action during the descent movement of the flipper while it is not stressed during an ascent movement. In fact, because of the position of the flexible element under the flexible wing section, when the swimmer describes a descent movement, the wing section is supported on the flexible element, which increases the stiffness of the wing section. On the contrary, during the ascent movement, the flexible wing section flexes independently of the flexible element, its stiffness not being increased. Therefore, the flexible wing section flexes asymmetrically, the flipper opposing a more substantial force during a descent movement than during an ascent movement, which optimises exploitation of the power of the legs during flapping of the feet or using the flipper as a training-training tool so as to have the muscle groups of the legs work differently.

Also, the design of the flipper forming the subject matter of the invention is simplified in comparison to that described in document DE 4 338 610.

According to the invention, the securing portion consists of a removable attachment system, the purpose of which is to be able to replace the flexible elements for example in the event of their deterioration or even modify the stiffness of said flexible elements and accordingly to vary asymmetrical flexing, for example as a function of the user. Of course, the securing portion can consist of a traditional fixing system, that is, non-removable, without departing from the scope of the present invention, such a fixing system in this case and for example able to be implemented by moulding of the proximal part of the wing section on the proximal part of the flexible element or flexible elements.

Preferably, the proximal part of the flexible wing section comprises at least one orifice and the proximal part of the flexible element comprises at least one attachment head passing through said orifice on the flexible wing section. Also, at least one removable attachment piece cooperates with said at least one attachment head so as to sandwich the flexible wing section between the flexible element and the at least one attachment piece. Of course, other removable attachment systems are feasible without departing from the scope of the present invention.

According to a preferred and non-limiting mode, the at least one attachment head comprises a longitudinal slot and at its end a rim extending to the exterior of the periphery of said attachment head. Also, the attachment piece has at least one orifice via which the rim is able to pass when the longitudinal slot of the attachment head is compressed. Also, the at least one attachment head has a length corresponding to the total thickness of the flexible wing section, in its proximal part where the securing portion is placed, and of the attachment piece.

Preferably and non-limiting, the two branches extend respectively near the lateral edges of the flexible wing section. Of course, a flexible element comprising a greater number of branches, for example, three branches, could be provided, two of the branches being placed near the lateral edges of the flexible wing section and the third placed in the central part of said flexible wing section. Also, it can also be that these branches are all connected together by means of a single base or even that each of said branches has an individual base constituting the proximal part of the flexible element, secured to the proximal part of the flexible wing section.

Preferably, the longitudinal branches are connected together by a single base comprising three attachment heads uniformly distributed vis-à-vis the proximal part of the wing section. Also, the attachment piece and the flexible wing section each comprise three orifices distributed uniformly, identically to the three attachment heads on the base.

Preferably and non-limiting, the securing portion is placed in the first quarter of the flexible wing section.

Preferably and non-limiting, the flexible element and especially the flexible branches, extend over a length corresponding to three quarters of the length of the flexible wing section.

Preferably, the flexible element placed on the flexible wing section have rigidity greater than that of said flexible wing section.

According to an embodiment of the flipper forming the subject matter of the present invention, apart from the above characteristics, the latter comprises a removable attachment device which is arranged between the bootee and the flexible wing section. The advantage of this is to make the bootee removable vis-à-vis the flexible wing section especially with the aim of adapting the bootee as a function of the foot of the user.

According to this embodiment, the bootee comprises a rigid fixture and a supple bootee element which is placed above the rigid fixture. This rigid fixture and this supple bootee element are secured together. The flexible wing section comprises a flexible wing section part extended to the rear by a rigid support part. Also, locking means are arranged between the support part and the rigid fixture.

According to this embodiment of the flipper, the rigid fixture and the supple bootee element are independent of each other, assembly means being arranged between the rigid fixture and the supple bootee element. The advantage of this is to conserve the rigid fixture and adapt only the supple bootee element as a function of the foot of the user. It could however be envisaged that the rigid fixture and the supple bootee element are made of one and the same inseparable element, the rigid fixture being for example moulded onto the footwear element.

According to this embodiment of the flipper, the rigid support part of the flexible wing section comprises a proximal central edge, placed transversally on the flexible wing section, and two support branches extending longitudinally to the rear relative to the lateral sides of the proximal central edge. Also, the locking means are arranged between the proximal central edge of the support part and the front edge of the rigid fixture and between the distal ends of the two support branches of said rigid support part and the two rear lateral ends of the rigid fixture.

BRIEF DESCRIPTION OF THE DRAWINGS

The characteristics and advantages of the present invention will emerge from the following description of a preferred design embodiment supported by the figures, in which.

DETAILED DESCRIPTION

Figure 1:
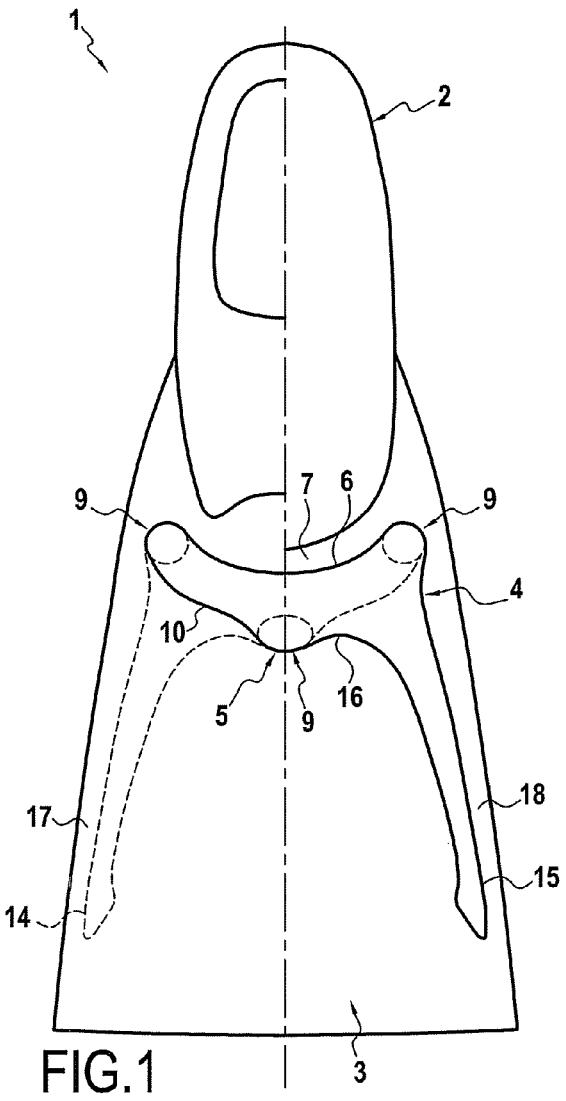
FIG. 1 illustrates in a plan view the flipper forming the subject matter of the invention, the left side relative to the axis of symmetry illustrating the top of the flipper whereas the right side illustrates the underneath of this flipper.
Figure 2:
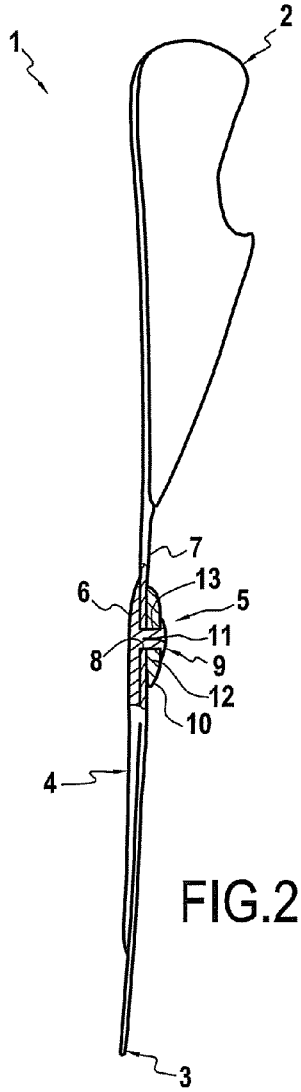
FIG. 2 illustrates a side elevation according to the axis of symmetry of the flipper.
Figure 3:
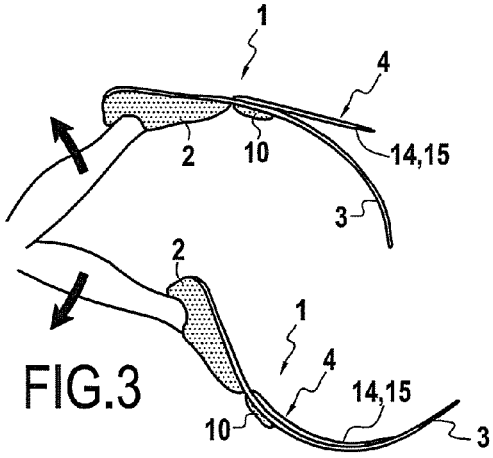
FIG. 3 illustrates flapping of feet with the flippers forming the subject matter of the present invention showing the action of the flexible element placed under the wing section, acting as such as stiffener.

It is evident that the flipper 1 conventionally comprises a bootee 2 and a wing section 3. In FIGS. 1 to 3, the bootee 2 is closed, that is, it completely encloses the foot. However, using the present invention on an open bootee at the level of its rear end is feasible, which in this case comprises a strap supported on the heel of the foot.

The flexible wing section 3 is secured to the front of the bootee, such as illustrated especially in FIGS. 1 and 2. For example, the proximal end of the wing section is moulded on the bootee. This flexible wing section 3 is capable of flexing during movements of descent and ascent of the flipper during flapping of feet, such as illustrated in FIG. 3.

It is evident in these FIGS. 1 to 3 that the flipper 1 comprises a flexible element 4 which is placed below the wing section 3. This flexible element 4 preferably comprises two flexible branches 14, 15 which extend longitudinally as far as three quarters of the length of the wing section, near the lateral edges 17, 18 of said wing section 3, such as illustrated in FIG. 1. Also, these flexible branches 14, 15 are connected together by a base 16 which preferably has an incurved form fitting the front contour of the bootee 2. This base 16 constituting the proximal part 6 of the flexible element 4 is secured to the proximal part of the wing section 3 by securing portion 5, such as illustrated in FIGS. 1 and 2. For this, a fixing system 5 is arranged between the base 16 and the proximal part 7 of the wing section.

Preferably, this fixing system is constituted both by attachment heads 9, such as illustrated in FIG. 2, the attachment head passing through an orifice 8 arranged on the proximal part 7 of the wing section 3, and also an attachment piece 10 comprises an orifice 13 through which the attachment head 9 is capable of passing. It is evident that the attachment head comprises a longitudinal slot 11 illustrated in FIG. 2 and a rim 12 extending to the exterior at the end of said attachment head 9. When the longitudinal slot 11 is compressed, the rim 12 has a diameter less than those of the orifices 8 and 13, respectively on the wing section 3 and the attachment piece 10. In this way, the attachment head 9 passes through the orifice 8 on the wing section then through the orifice 13 of the attachment piece 10, while retaining the compressed longitudinal slot 11. Once this longitudinal slot 11 relaxes, the rim 12 resumes its normal diameter greater than the diameter of the orifices 8 and 13 respectively on the wing section 3 and on the attachment piece 10, which keeps the attachment piece 10 in position, wedged by the rim 12 and thus sandwiches the wing section 3 between the base 16 and said attachment piece 10.

Such as illustrated in FIG. 2, the length of the attachment head 9 corresponds more less to the total thickness of the wing section 3 in its proximal part 17 and of the attachment piece 10, ensuring appropriate securing between the base 16, the wing section 3 and the attachment piece 10 wedged by the rim 12. It is evident in FIG. 1 that three attachment heads 9 are arranged on the base 16, said attachment heads being distributed uniformly vis-à-vis the proximal part 17 of the wing section 3. This wing section 3 consequently has in its proximal part three orifices 8 distributed identically to the position of the attachment heads 9. Also, such as illustrated in FIG. 1, it is evident that the attachment piece 10 comprises forms and dimensions corresponding more or less to those of the base 16 of the flexible element 4, this attachment piece 10 also comprising three orifices 13 distributed uniformly identically to the orifices 8 of the wing section 3 and to the position of the three attachment heads 9 on the base 16. It would however be feasible to provide three separate attachment pieces for each of the attachment heads 9 on the base 16. Also, it is of course possible to provide a different number of attachment heads on the base 16. It would also be possible to provide individual branches 14, 15, that is, not connected by a single base 16, the securing portion being used directly in the proximal part of said branches and in the proximal part 7 of the wing section 3.

Preferably, such as illustrated in FIG. 1, securing of the base 16 of the flexible element 4 and the proximal part 7 of the wing section 3 is placed in the first quarter of said wing section 3, whereas the branches 14 and 15 of the flexible element 4 extend over a length corresponding more or less to three quarters of the flexible wing section 3, on its lateral edges 17, 18.

Preferably, these flexible branches have greater stiffness than that of the wing section 3. But this is not limiting since it is possible, due to the removable character of the attachment piece 10, to replace the flexible element 4 by another having different stiffness, more or less substantial, optionally less than the stiffness of the wing section.

Accordingly, as can be seen from FIG. 3, during a descent movement of the flipper 1 the lower face, that is the underneath of the wing section 3, is supported on the branches 14, 15 of the flexible element 4, whereas during an ascent movement of the flipper, because the branches 14, 15 are free vis-à-vis the underneath of the wing section 3, said wing section 3 flexes differently and independently of the flexible branches 14, 15 of the flexible element 4, ensuring asymmetrical flexing of the wing section 3 during flapping of the feet.

FIGS. 4*a* to 4*d* illustrate a variant design of the flipper which includes all the above characteristics of the description as to embodiment of the flexible element 4 illustrated in FIGS. 1 to 3.

According to this flipper 100 illustrated in FIGS. 4*a* to 4*d*, the bootee 200 is removable from the wing section 300. It is evident that the bootee 200 comprises a fixture 201 which is made of rigid material, and a footwear element 202 made of supple material. It is evident also in these FIGS. 4*a* to 4*d* that the footwear element 202 is independent of the rigid fixture 201. This footwear element 202 is fixed above the rigid fixture 201 by means of attaching straps 203, 204. It could however be feasible that this rigid fixture 201 and this footwear element 202 are made of one and the same piece, for example by moulding the material of the rigid fixture onto the material of the supple bootee element.

Figure 4A:
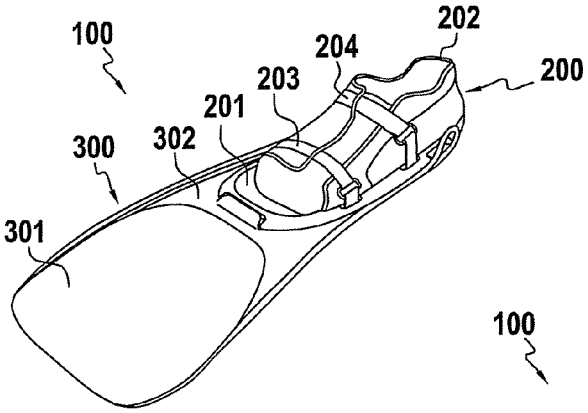
FIGS. 4*a*, 4*b*, 4*c*, 4*d* illustrate a design variant of the flipper according to which the bootee is removable from the flexible wing section. These FIGS. 4*a*, 4*b*, 4*c*, 4*d* do not illustrate the essential characteristics forming the subject matter of the present invention, specifically the flexible element and the securing portion of this flexible element. The flexible element and the securing portion of this flexible element could however be used with the flexible wing section such as illustrated in FIGS. 1 to 3 and described hereinbelow.
Figure 4B:
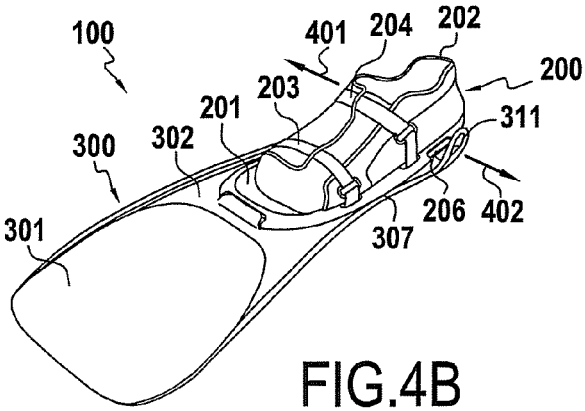
Figure 4C:
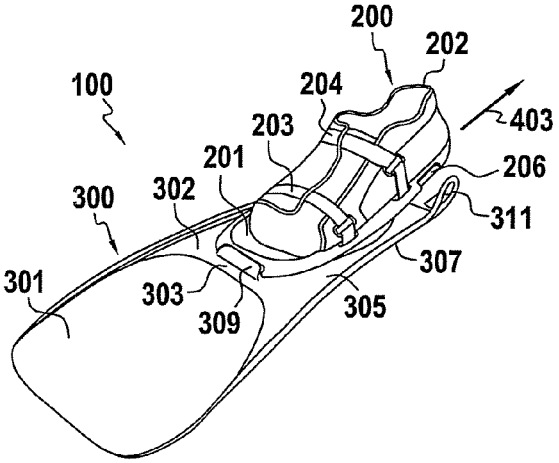
Figure 4D:
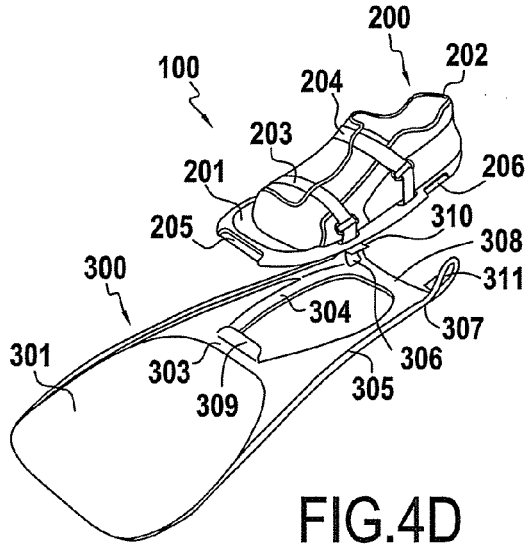

It is evident in FIGS. 4*a* to 4*d* that the flexible wing section 300 comprises a flexible wing section 301 part and a support part 302, more rigid that the wing section part 301. This support part 302 comprises a proximal central edge 303 placed transversally on the wing section 300 and two support branches 304, 305 which extend longitudinally to the rear of the flexible wing section and are placed on the lateral sides relative to the proximal central edge 303. It is evident also in FIG. 4*d* that the ends 306, 307 of these support branches 304, 305 are connected together by a transversal linking element 308. It is evident in FIGS. 4*a*, 4*d* that the proximal central edge 303 comprises a locking lug 309. Similarly, the ends 306, 307 of the two support branches 304, 305 each comprise locking lugs 310, 311. These locking lugs 310, 311 of the support branches 304, 305 are configured to be flexible, enabling slight deformation of the latter for locking of the bootee 200. To this effect, the rigid fixture 201 of the bootee 200 comprises at the level of its front edge a notch 205, such as illustrated in FIG. 4*d*. It is evident also in FIG. 4*d* that the first rear lateral end of the fixture 201 comprises a notch 206, which is also provided on the second rear lateral end of the fixture 201.

The bootee 200 is positioned on the flexible wing section 300 by placing the notch 205 at the level of the front edge of the rigid fixture 201 in the locking lug 309, then by wedging the rear end of the fixture 201, enabling displacement of the locking lugs 310, 311 at the level of the ends 306, 307 of the two support branches 304, 305 according to the direction of the arrows 401, 402 illustrated in FIG. 4*d*, until said locking lugs 310, 311 latch onto the notches 206 placed at the rear lateral ends of the rigid fixture 201.

This deformation of the locking lugs 310, 311 therefore latches said locking lugs in the notches 206 at the level of the rear lateral ends of the fixture 201. The bootee is then locked such as illustrated in FIG. 4*a*. The bootee 200 is withdrawn vis-à-vis the flexible wing section 300 according to the steps illustrated via FIGS. 4*a* to 4*d*, that is, by gripping the locking lugs 310, 311 at the level of the ends 306, 307 of the support branches 304, 305 and by shifting them according to the arrows 401, 402, then by pulling the bootee 200 to the rear according to the arrow 403 so as to disengage the notch 205 at the level of the front edge of the rigid fixture 201 vis-à-vis the notch lug 309 on the proximal central edge 303 of the support part 302.

The transversal element 308 advantageously ensures sufficient rigidity of the support part 302 so as to prevent the support branches 304, 305 from coming apart when the flipper is being used, ensuring appropriate locking of the bootee 200 on the flexible wing section 300. This transversal element 308 also contributes to transmitting force during swimming practice.

Other characteristics can be envisaged without departing from the scope of the present invention, especially as it relates to using the securing portion 5 between the flexible element 4 and the wing section 3.

The invention claimed is:

1. A flipper comprising a bootee extended to the front by a flexible wing section, wherein the flipper further comprises a flexible element having at least two branches extending in the direction of the length under the flexible wing section and a base, and a securing portion that is arranged so as to fix said base to the proximal part of said flexible wing section, wherein said flexible wing section remains movable relative to said at least two branches, the securing portion consisting of a removable attachment system comprising at least one orifice formed in the proximal part of the flexible wing section, at least one attachment head formed on the base and designed to pass through said orifice in a substantially transverse direction relative to the flexible wing section, and at least one removable attachment piece cooperating with said at least one attachment head such that the flexible wing section is sandwiched between the base and the at least one attachment piece.

2. The flipper as claimed in claim 1, said at least one attachment head comprising a longitudinal slot and at its end a rim, the attachment piece having at least one orifice through which the rim is able to pass when the longitudinal slot of the attachment head is compressed, said at least one attachment head having a length corresponding to the total thickness of the flexible wing section, in its proximal part, and of the attachment piece.

3. The flipper as claimed in claim 1, the two branches extending respectively near the lateral edges of the flexible wing section.

4. The flipper as claimed in claim 1, the attachment piece comprising a form and dimensions corresponding substantially to those of the base.

5. The flipper as claimed in claim 4, the base comprising three attachment heads distributed uniformly and the attachment piece and the flexible wing section each comprising three orifices distributed identically to said three attachment heads.

6. The flipper as claimed in claim 1, wherein the securing portion is placed in the first quarter of the flexible wing section.

7. The flipper as claimed in claim 1, wherein the branches of the flexible element extend over a length corresponding to three quarters of the flexible wing section.

8. The flipper as claimed in claim 1, wherein the flexible element has greater rigidity than the flexible wing section.

9. The flipper as claimed in claim 1, in which a first locking device is arranged between the bootee and the flexible wing section.

10. The flipper as claimed in claim 9, wherein the bootee comprises a rigid fixture and a supple bootee element, placed above the rigid fixture, said rigid fixture and supple bootee elements being secured together, the flexible wing section comprising a flexible wing section extended to the rear by a rigid support part, a second locking device being arranged between the support part and the rigid fixture.

11. The flipper as claimed in claim 10, wherein the rigid fixture and the supple bootee element are independent of each other, and an assembly device is arranged between the rigid fixture and the supple bootee element.

12. The flipper as claimed in claim 10, wherein the rigid support part comprises a proximal central edge and support branches that extend longitudinally to the rear relative to the lateral sides of said proximal central edge, wherein the second locking device is arranged between the proximal central edge of the support part and the front edge of the rigid fixture and between the distal ends of the support branches of the support part and the rear lateral ends of the rigid fixture.

13. A flipper comprising a bootee extended to the front by a flexible wing section wherein the flipper further comprises a flexible element having at least two branches extending in the direction of the length under the flexible wing section and a base, and a securing portion that is arranged so as to fix said base to the proximal part of said flexible wing section, wherein said flexible wing section remains movable relative to said at least two branches, the securing portion consisting of a removable attachment system comprising at least one orifice formed in the proximal part of the flexible wing section, at least one attachment head formed on the base and designed to pass through said orifice, and at least one removable attachment piece cooperating with said at least one attachment head such that the flexible wing section is sandwiched between the base and the at least one attachment piece, said at least one attachment head comprising a longitudinal slot and at its end a rim, the attachment piece having at least one orifice through which the rim is able to pass when the longitudinal slot of the attachment head is compressed, said at least one attachment head having a length corresponding to the total thickness of the flexible wing section, in its proximal part, and of the attachment piece.

14. A flipper comprising a bootee extended to the front by a flexible wing section wherein the flipper further comprises a flexible element having at least two branches extending in the direction of the length under the flexible wing section and a base, and a securing portion that is arranged so as to fix said base to the proximal part of said flexible wing section, wherein said flexible wing section remains movable relative to said at least two branches, the securing portion consisting of a removable attachment system comprising at least one orifice formed in the proximal part of the flexible wing section, at least one attachment head formed on the base and designed to pass through said orifice, and at least one removable attachment piece cooperating with said at least one attachment head such that the flexible wing section is sandwiched between the base and the at least one attachment piece, said attachment piece comprising a form and dimensions corresponding substantially to those of the base.

15. The flipper as claimed in claim 14, the base comprising three attachment heads distributed uniformly and the attachment piece and the flexible wing section each comprising three orifices distributed identically to said three attachment heads.

* * * * *